US005970734A

United States Patent [19]

Stillwell et al.

[11] Patent Number: 5,970,734

[45] **Date of Patent: *Oct. 26, 1999**

[54] METHOD AND SYSTEM FOR CREATING AND MAINTAINING A FROZEN SURFACE

[76] Inventors: Robert Stillwell; Michael Rzechula, both of c/o Innovative Concepts Enterprises, 100 Highway 34 South, Harrisburg, Ill. 62946

[ * ] Notice: This patent issued on a continued prosecution application filed under 37 CFR 1.53(d), and is subject to the twenty year patent term provisions of 35 U.S.C. 154(a)(2).

[21] Appl. No.: 08/722,489

[22] Filed: Sep. 27, 1996

Related U.S. Application Data

[60] Provisional application No. 60/004,599, Sep. 29, 1995.

[51] Int. Cl.[6] ..... A63C 19/10

[52] U.S. Cl. ..... 62/235; 285/305

[58] Field of Search ..... 62/235, 434; 285/305

[56] References Cited

U.S. PATENT DOCUMENTS

| | | | |
|---|---|---|---|
| 1,634,938 | 7/1927 | Funk | 62/235 |
| 2,726,658 | 12/1955 | Chessey | 62/434 |
| 3,751,935 | 8/1973 | MacCracken et al. | 62/235 |
| 3,893,507 | 7/1975 | MacCracken et al. | 62/235 |
| 3,910,059 | 10/1975 | MacCracken | 62/235 |
| 4,394,817 | 7/1983 | Remilliard | 62/235 |
| 4,894,156 | 1/1990 | Murken | 285/305 |
| 4,979,373 | 12/1990 | Huppee | 62/235 |

*Primary Examiner*—William E. Tapolcai
*Attorney, Agent, or Firm*—Wood, Phillips, VanSanten, Clark & Mortimer

[57] ABSTRACT

A method of manufacturing a tube includes the steps of preparing a composition using ethylene vinyl acetate, extruding the composition to form a tube, and cooling the tube with the tube in a substantially straight configuration so that the tube is substantially set in a substantially straight configuration. Moreover, a system for creating a frozen surface on a medium includes a mechanism for exchanging thermal energy between a medium and a coolant, a mechanism for removing thermal energy from a coolant, and a mechanism for transporting a coolant between the mechanism for exchanging thermal energy between a medium and a coolant and the mechanism for removing thermal energy from a coolant. The mechanism for transporting a coolant includes first and second pipes and mechanism for releasable connecting the first pipe to the second pipe so as to prevent the first pipe from moving axially relative to the second pipe in a first operational state, and to allow the first pipe to be moved axially relative to the second pipe in a second operational state. Additionally, a system for creating and maintaining a frozen surface on a medium includes a mechanism for exchanging thermal energy between a medium and a coolant, the mechanism for exchanging thermal energy between a medium and a coolant having a substantially uniform cross-sectional area for passing a coolant therethrough. The system also includes a mechanism for removing thermal energy from a coolant. The system further includes a mechanism for transporting a coolant between the mechanism for exchanging thermal energy between a medium and a coolant and the mechanism for removing thermal energy from a coolant. The mechanism for transporting a coolant is connected to the mechanism for exchanging thermal energy between a medium and a coolant so that substantially all of a coolant flowing from the mechanism for transporting a coolant to the mechanism for exchanging thermal energy between a medium and a coolant flows directly from the mechanism for transporting a coolant into the mechanism for exchanging thermal energy between a medium and a coolant.

10 Claims, 9 Drawing Sheets

METHOD AND SYSTEM FOR CREATING AND MAINTAINING A FROZEN SURFACE

This application claims the benefit of U.S. Provisional Application No. 60/004,599, filed on Sep. 29, 1995.

FIELD OF THE INVENTION

This invention relates to a method of manufacturing a tube. This invention also relates to a system for creating and maintaining a frozen surface, for example, for recreational exhibitions and athletic competitions at an ice skating rink. In particular, this invention relates to a system for efficiently conveying a coolant through a medium to be frozen. This invention also relates to a system that lends itself to facilitate installation and maintenance.

BACKGROUND OF THE INVENTION

The earliest ice skating rinks were frozen ponds or lakes. Such ice sport venues had the sizeable limitation that their existence was entirely dependent upon the temperature of the environment. For a long time, the dependency upon naturally-formed ice restricted the enjoyment of ice sports in most countries to a limited seasonal period.

In the late nineteenth century, indoor ice skating rinks were designed to provide venues on which ice sports could be enjoyed in most countries year-round. These early indoor ice skating rinks used a system of steel or iron pipes to carry an artificially-cooled refrigerant, such as calcium chloride brine, under a tank of water to create a frozen surface capable of being skated upon. The steel or iron pipes were embedded in concrete or sand beneath the tank, and had an inner diameter of 1 to 1½ inches with 4 inches between the centers.

While capable of providing a frozen surface which could be skated upon indoors year-round, the steel or iron pipe construction had its drawbacks. Perhaps, one of the greatest limitations on the steel or iron constructions was the surface area that these systems provided for heat exchange with the medium to be frozen, also known as the dynamic surface area. In the steel or iron constructions, as structurally and dimensionally described above, the dynamic surface area was substantially less than the area of the skating surface available for heat exchange with the environment. The dynamic surface area of the steel or iron constructions is estimated to be at most 82% of the skating surface area.

More recently, ice skating rink systems have been constructed using smaller diameter plastic tubing, such as those systems described in U.S. Pat. Nos. 3,751,935; 3,893,507; and 3,910,059. In operation, a main supply pipe, or header, feeds into a plurality of supply subheaders, each of which in turn is attached to the proximal ends of a plurality of coolant tubes. The plurality of coolant tubes can be fastened at their distal ends to one end of a plurality of U-shaped connectors, which in turn are fastened to a second plurality of coolant tubes. The second plurality of coolant tubes is attached at their proximal ends to a plurality of return subheaders, which in turn feed into a main return header. The inner diameter of the coolant tubes used in these plastic constructions generally varies from ¼ to ½ inches. By using a smaller center spacing between smaller tubes, thee plastic systems may provide a larger dynamic surface area than the steel or iron constructions.

However, the dynamic surface area is only one factor influencing the overall efficiency of a system designed to create and maintain a frozen surface. As important to the efficiency of the system as the dynamic surface area is the ability of the coolant to flow through the system without significant pressure loss or flow interruption. As a consequence, even though the plastic systems may have improved the dynamic surface area over the iron and steel constructions, the efficiency of these plastic systems is often significantly compromised in practice by unsatisfactory coolant flow characteristics at various points in the system.

For example, as shown in FIGS. 1 and 2 herein, one common area for flow restriction to occur is at the transfer point between a subheader 30 and a coolant tube 32. In the conventional construction shown in FIGS. 1 and 2, the subheader 30 has an opening 34, through which is disposed a connection fitting 36. The connection fitting 36 is soldered into place with the proximate end of the fitting 36 occluding as much as 25 percent of the interior cross-sectional area of the subheader 30. This occlusion can cause a layer 38 of coolant to build up against the fitting 36, and seriously degrade the flow characteristics of the coolant in the area adjoining the transfer point.

Moreover, at the distal end of the tube 32, where the tube 32 attaches to a U-shaped connector 40, the conventional methods of construction can cause additional flow restriction problems. One flow restriction problem commonly occurring in conventional constructions is illustrated in FIGS. 3 and 4. The U-shaped connector 40 shown is fabricated by bending a copper tube having an internal diameter similar to that of the coolant tube 32. By using this method of fabrication, the resulting inner diameter at a bight 42 of the U-shaped connector 40 may be reduced to approximately half the diameter of the original copper tube. The dramatic decrease in the inner diameter of the U-shaped connector 40 at the bight 42 has a proportionally dramatic effect on the fluid flow throughout the system.

Additionally, loss of flow pressure can result from the present methods of system construction used to join the coolant tubes 32 with the U-shaped connectors 40. The coolant tubes 32 are fastened directly to the U-shaped connectors 40 by means of glue and a circular clamp or an eyelet, as shown in FIGS. 3 and 4. As a consequence, the tubes 32 have a tendency to leak, or even pop off of the U-shaped connector 40, spilling coolant directly into the medium to be frozen and underlying foundational material and decreasing the pressure and flow rate at which the coolant is being transported throughout the system.

Furthermore, these plastic systems are often constructed using a type of plastic coolant tube having unfavorable performance characteristics. Commonly, polyethylene or polypropylene tubing is used for the coolant tubes in plastic ice skating rink systems. During manufacture, the polyethylene or polypropylene tubing is usually extruded, and then passed through a standard length (10–14 foot) cooling tank before being machine-coiled on to spools for delivery. As a consequence of this method of fabrication, the polyethylene or polypropylene tubing thermally sets with a curved, rather than a straight, structure in the memory of the plastic. Therefore, when the tubing is uncoiled to be used in the plastic construction illustrated in the patents mentioned above, the tubing does not naturally lay straight and flat, but takes on a serpentine structure in at least one plane.

As a further consequence, when these polyethylene or polypropylene ice rink systems are installed, the coolant tubing will commonly force its way under pressure to the skating surface, and protrude from the surface of the ice, providing a substantial obstacle and hazard for persons, for example skaters, using the frozen surface. It is therefore necessary to resubmerge the tubing under the surface of the ice through a method known as "burning in". The tubing is "burned" into the surface of the ice by melting the surrounding ice, and then holding the tube in place under pressure until the ice reforms around the problematic section of tubing. Because of the pressure of the coolant running through the tubing, as well as the thermally-set disposition of the tubing to return to the serpentine structure, it may be necessary to repeat the "burning in" process a number of times each season to maintain a skating surface free from obstructions and to prevent damage to the tubing.

However, polyethylene and polypropylene tubing is sensitive to repeated bending. Repeated bending of the polyethylene or polypropylene tubing has been known to cause permanent damage to the tubing, and can result in the cracking or rupture of the tubing with a concomitant loss of coolant pressure in the system.

SUMMARY OF THE INVENTION

According to an aspect of the present invention, a method of manufacturing a tube includes the steps of preparing a composition using ethylene vinyl acetate, extruding the composition to form a tube, and cooling the tube with the tube in a substantially straight configuration so that the tube is substantially set in a substantially straight configuration.

According to another aspect of the present invention, a system for creating a frozen surface on a medium includes a mechanism for exchanging thermal energy between a medium and a coolant, a mechanism for removing thermal energy from a coolant, and a mechanism for transporting a coolant between the mechanism for exchanging thermal energy between a medium and a coolant and the mechanism for removing thermal energy from a coolant. The mechanism for transporting a coolant includes first and second pipes and a mechanism for releasable connecting the first pipe to the second pipe so as to prevent the first pipe from moving axially relative to the second pipe in a first operational state, and to allow the first pipe to be moved axially relative to the second pipe in a second operational state.

According to a further aspect of the present invention, a system for creating and maintaining a frozen surface on a medium includes a mechanism for exchanging thermal energy between a medium and a coolant, the mechanism for exchanging thermal energy between a medium and a coolant having a substantially uniform cross-sectional area for passing a coolant therethrough. The system also includes a mechanism for removing thermal energy from a coolant. The system further includes a mechanism for transporting a coolant between the mechanism for exchanging thermal energy between a medium and a coolant and the mechanism for removing thermal energy from a coolant. The mechanism for transporting a coolant is connected to the mechanism for exchanging thermal energy between a medium and a coolant so that substantially all of a coolant flowing from the mechanism for transporting a coolant to the mechanism for exchanging thermal energy between a medium and a coolant flows directly from the mechanism for transporting a coolant into the mechanism for exchanging thermal energy between a medium and a coolant.

DESCRIPTION OF THE PREFERRED EMBODIMENTS

In general terms, the system of the present invention creates and maintains a frozen surface, such as ice, by removing thermal energy from a liquid medium, such as water, and exhausting the thermal energy at a location remote to the medium to be frozen. Specifically with reference to FIG. 5, pressurized, chilled coolant passes through a plurality of tubes spaced within a tank or container 46 holding the medium to be frozen. As the coolant passes through the plurality of tubes, thermal energy is transferred from the medium to the coolant through the walls of the tubes. The coolant then passes from the tubes to a pump 54, and from the pump 54 to a refrigeration unit 70. The refrigeration unit 70 extracts the thermal energy from the coolant and returns the chilled coolant to the collection tank 68, whereupon the cycle is repeated.

Figure 1:
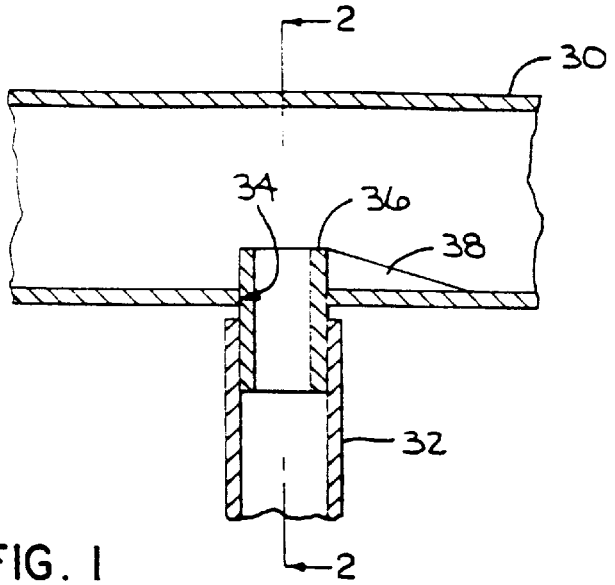
FIG. 1 (PRIOR ART)
FIG. 1 is a partial cross-sectional view of a portion of a prior art subheader showing in detail the transfer point between the subheader and a coolant tube.
Figure 2:
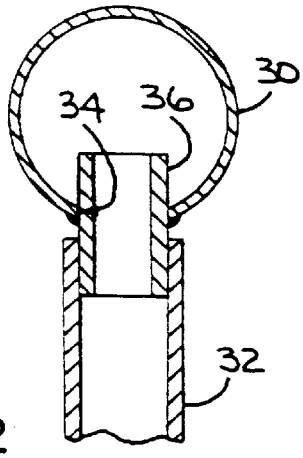
FIG. 2 (PRIOR ART)
FIG. 2 is a partial cross-sectional view of the transfer point between the subheader and the coolant tube taken about line 2—2 in FIG. 1.
Figure 3:
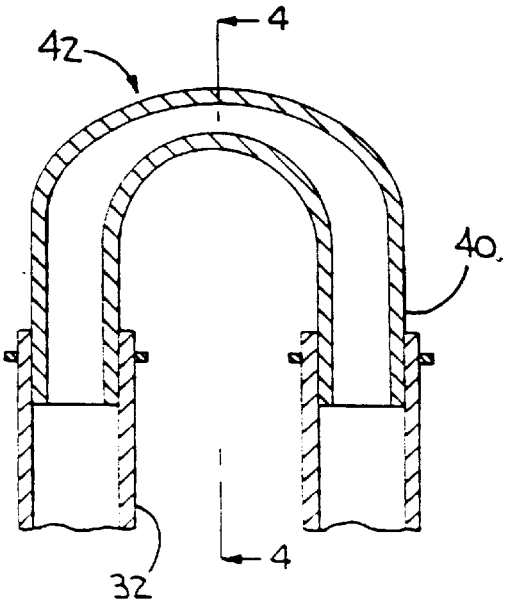
FIG. 3 (PRIOR ART)
FIG. 3 is a partial cross-sectional view of a prior art U-shaped connector showing in detail the connection of the U-shaped connector and a coolant tube.
Figure 4:
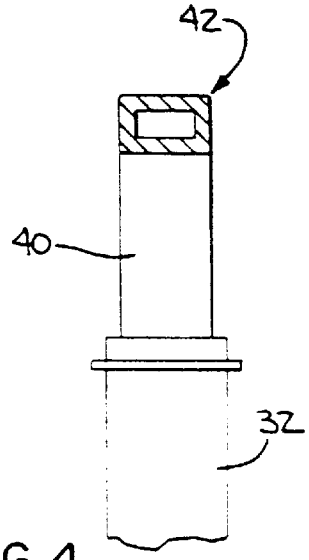
FIG. 4 (PRIOR ART)
FIG. 4 is a partial cross-sectional view of the connection of the U-shaped connector and the coolant tube taken about line 4—4 in FIG. 3.
Figure 5:
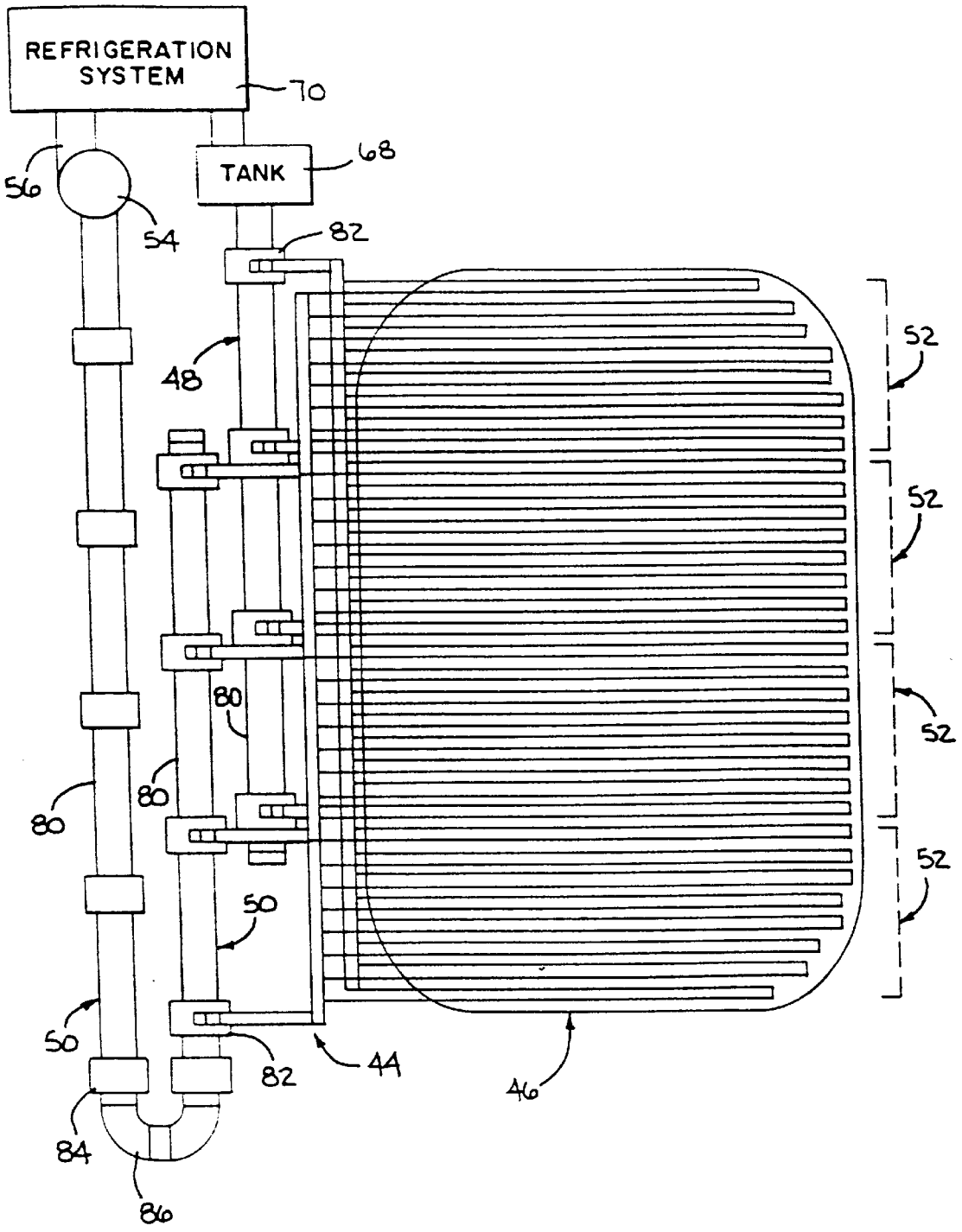
FIG. 5 is an overall plan view of an ice skating rink including an embodiment of the present invention for creating and maintaining a frozen surface.

According to an embodiment of the present invention, a system 44 for creating and maintaining a frozen surface is shown in FIG. 5. The system 44 in FIG. 5 is shown fitted in a tank or rink 46. The rink system 44 includes a main supply header 48, a main return header 50, and a plurality of panels 52. Unlike the constructions discussed above, the panels 52 used in the embodiments of the present invention discussed herein are placed within the medium to be frozen, rather than being embedded in or placed underneath inches of sand or concrete beneath the rink 46, although such a configuration is possible using the present invention. As a consequence of the direct thermal energy exchange relationship between the coolant in the panels 52 and the medium to be frozen, the efficiency of the system 44 is improved as a whole as it is unnecessary to first cool the floor of the tank 46 prior to cooling the medium to be frozen.

Figure 6:
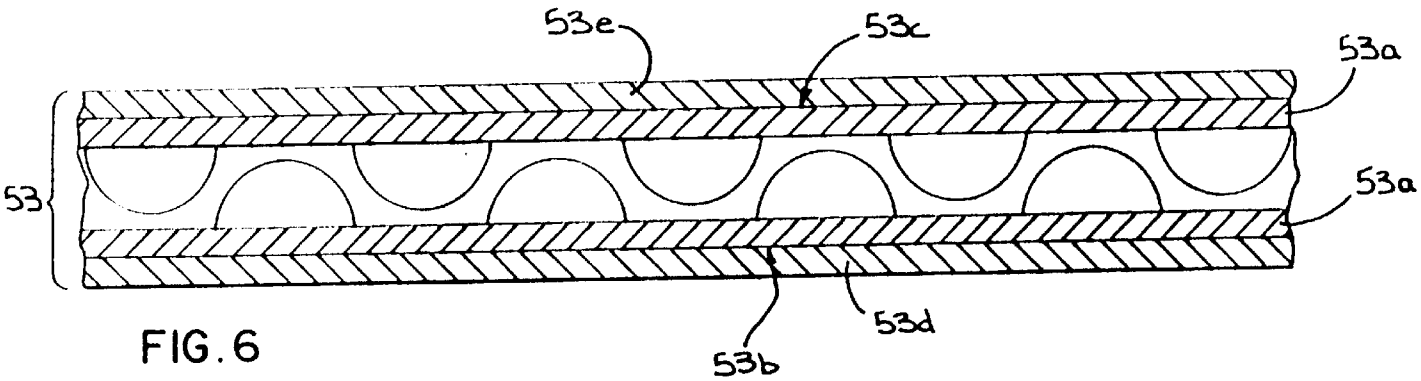
FIG. 6 is an enlarged, partial cross-sectional view of an insulation blanket or layer which is useful for insulating below the system shown in FIG. 5.

To preserve the advantages of this direct thermal energy exchange relationship by preventing thermal energy from entering the tank from surface below the tank 46, an insulation layer or blanket 53, as shown in FIG. 6, is placed beneath the panels 52. The insulation layer 53 is fabricated in a sandwich construction in which two layers of bubble packaging material 53*a* are laid face to face such that the bubbles of one layer fit within the dimples of the other layer. The two layers 53*a* are then covered on the externally facing surfaces 53*b*, 53*c* with a layer 53*d* of foil on the surface 53*b*, and a layer 53*e* of foil, or polyethylene, on the surface 53*c*. During installation, the layer 53*d* is placed against the surface below the tank 46, while the layer 53*e* faces and is covered by the medium to be frozen.

A pump 54 is connected at an outlet 56 to the main supply header 48 via the refrigeration system 70 and the collection tank 68, and forces a coolant, for example, a mixture of either ethylene glycol or propylene gylcol and water, into the main supply header 48 under pressure. Under most conditions, the coolant is, for example, a mixture of either ethylene glycol or propylene glycol and water in a ratio of 45:55. If the system 44 is intended for use in a environment where the temperature of the surrounding environment is less than −20 degrees F., the coolant is, for example, a mixture of either ethylene glycol or propylene glycol and water in a ratio of 55:45. The coolant passes from the main supply header 48 and into the individual panels 52.

Figure 7:
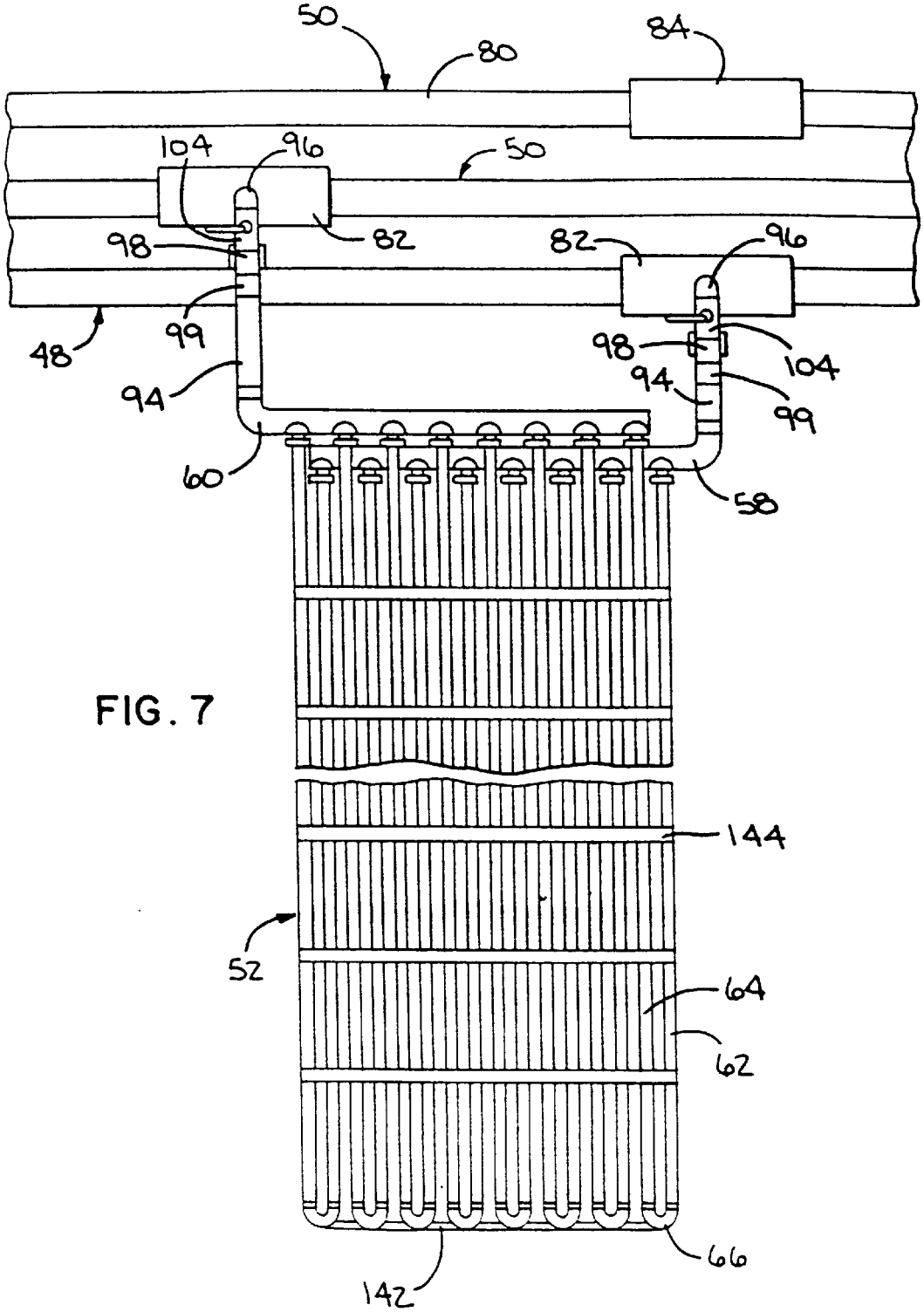
FIG. 7 is an enlarged plan view showing in detail an embodiment of a panel for use in the embodiment shown in FIG. 5, and the interconnection of the panel with supply and return headers.
Figure 8:
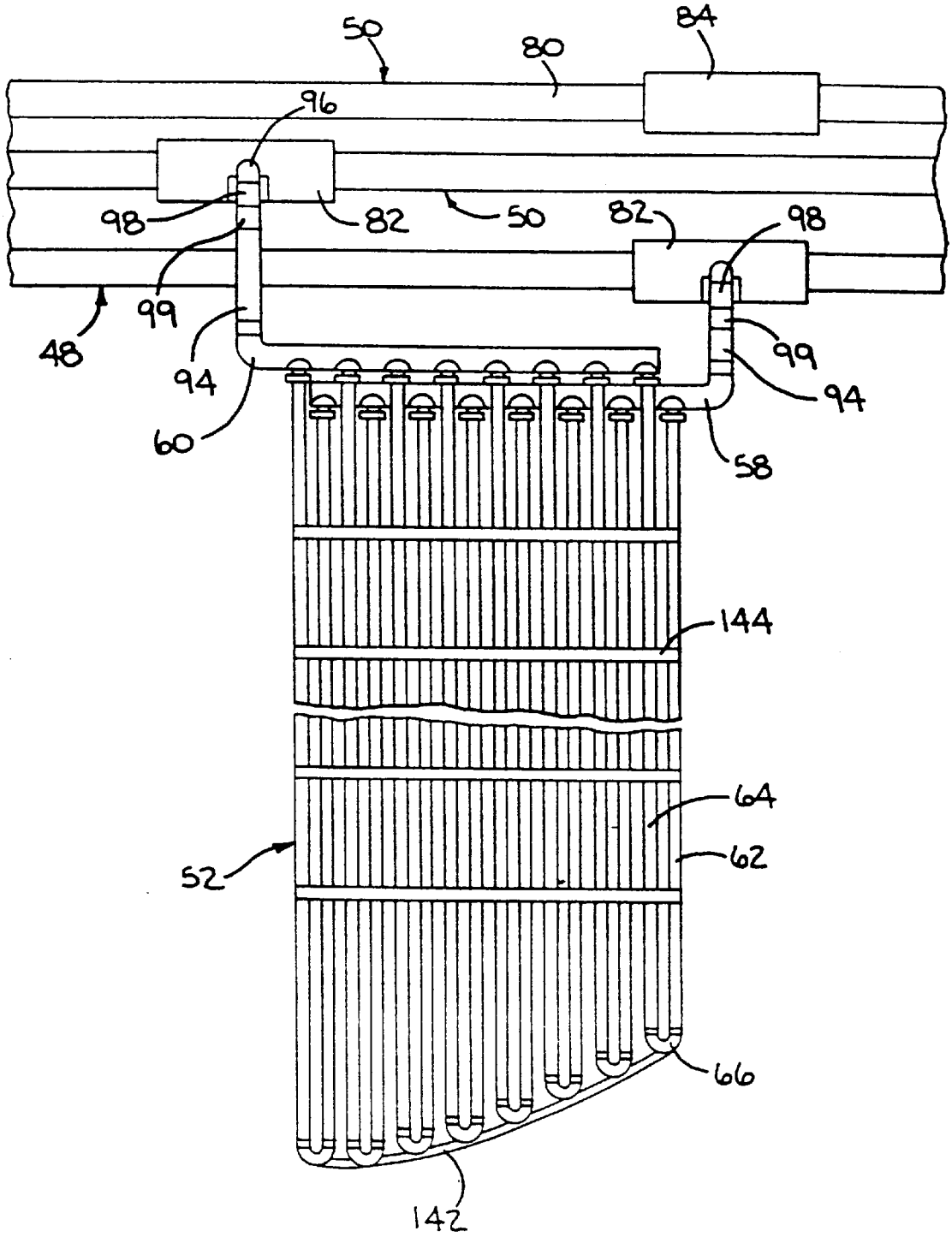
FIG. 8 is an enlarged plan view showing in detail another embodiment of a panel for use in the embodiment shown in FIG. 5 in particular at the curved ends of the ice skating rink, and the interconnection of the panel with supply and return headers.

Each panel 52, generally indicated in FIG. 5 and shown in greater detail in FIGS. 7 and 8, is four feet wide and 100 feet long, and includes a supply subheader 58, a return subheader 60, first and second plurality of tubes 62, 64, and a plurality of U-shaped connectors 66. The pressurized coolant flows from the main header 48 into the supply subheader 58, which feeds into the first plurality of tubes 62. As the coolant flows through the medium, thermal energy is transferred from the medium to the coolant through the walls of the tubes 62. The coolant then passes through the plurality of U-shaped connectors 66 and into the second plurality of tubes 64. As the coolant flows through the medium for a second time, additional thermal energy is transferred from the medium to the coolant.

The coolant feeds from the plurality of tubes 64 to the return subheaders 60, which are connected to the return header 50. The coolant is transported along the return header 50 to the pump 54, from which the coolant returns to the refrigeration system 70. The refrigeration system 70 extracts the thermal energy from the coolant, and exhausts the thermal energy to the environment. The chilled coolant is then returned to the collection tank 68, for example a 15 gallon tank, to be re-introduced into the main header 48.

Figure 9:
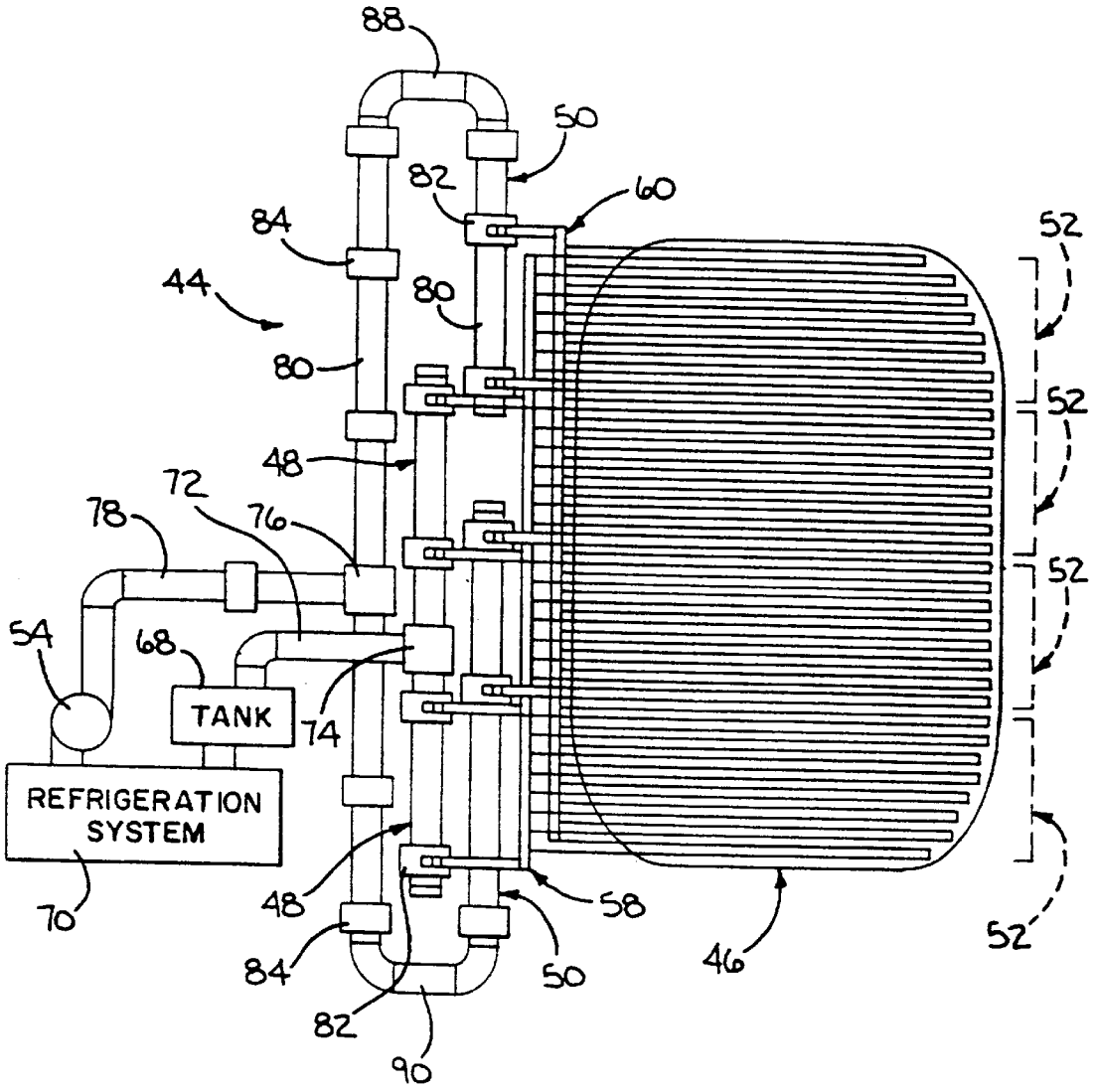
FIG. 9 is an overall plan view of an ice skating rink including another embodiment the present invention for creating and maintaining a frozen surface with the spacers and spacing bars removed.

Alternatively, the system 44 may be configured to accommodate placement of the refrigeration system 70 and pump 54 at the center of the rink 46. As shown in FIG. 9, with like numbers used for like elements, a central supply header 72 is connected through the refrigeration system 70 and a collection tank 68 to the pump 54, branching off at a first T-joint 74 to form two main supply headers 48, one for each half of the rink 46. The supply headers 48 each feed into a plurality of subheaders 58, which in turn feed into a plurality of panels 52 in a direct thermal energy transfer relationship with the medium to be frozen. The coolant returns to the refrigeration system 70 via a system of return subheaders 60 and return headers 50. The return headers 50 are connected at a second T-joint 76 to form a main return header 78, which feeds directly into the pump 54.

Because the system 44 can be assembled to accommodate rinks of different widths and lengths by adding additional panels 52, the requirements for the pump size and the pressure and flow rate of coolant (expressed as gallons per unit of time) will necessarily differ according to the exact dimensions of the assembled system 44. The coolant has an inlet temperature (as measured at the inlet of the supply header 48) of 18–20 degrees F., and an outlet temperature (as measured at the inlet of the pump 54) of 20–24 degrees F. It has been found experimentally that to provide a uniform thermal energy transfer, or thermal energy extraction, from the medium to be frozen, the velocity of the coolant in the system 44 should be at least 1 foot/second.

In an embodiment of the present invention, wherein the rink system 44 may be assembled and disassembled, for example at the end of a seasonal period or after an athletic competition or exhibition, the supply header 48 and the return header 50 are made from lengths of pipe 80, for example, enhanced PVC pipe (type 1, grade 1, 2000 psi hydrostatic stress material, in accordance with ASTM D1784) with an inner diameter of between 2 to 6 inches, for example 4 inches, joined together at spaced intervals by connectors 82, 84, also fabricated from enhanced PVC schedule 80 pipe. The lengths of pipe 80 are joined together at four foot intervals to coincide with the four foot width of the panels 52.

Figure 11:
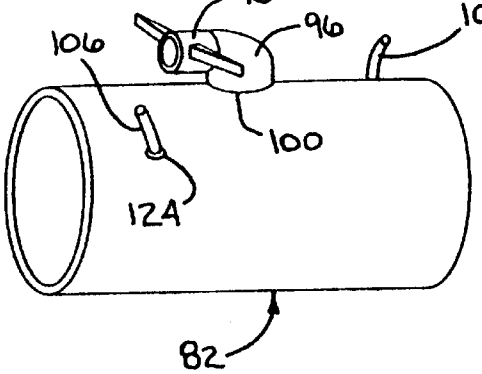
FIG. 11 is an enlarged plan view of another embodiment of a spline-connector for use in the embodiment shown in FIG. 5, the spline-connector including a releasably attachable coupling connected to a fixed coupling attached directly to the spline-connector.
Figure 12:
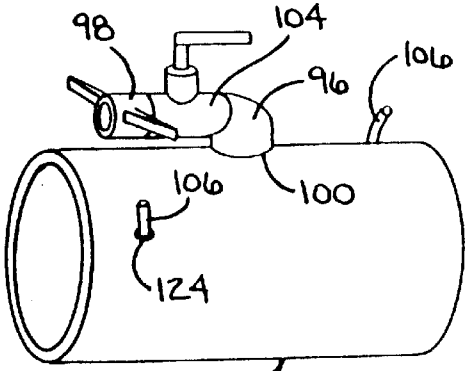
FIG. 12 is an enlarged plan view of still another embodiment of a spline-connector for use in the embodiment shown in FIG. 5, the spline-connector including a valve connected between a releasably attachable coupling and a fixed coupling attached directly to the spline-connector.
Figure 10:
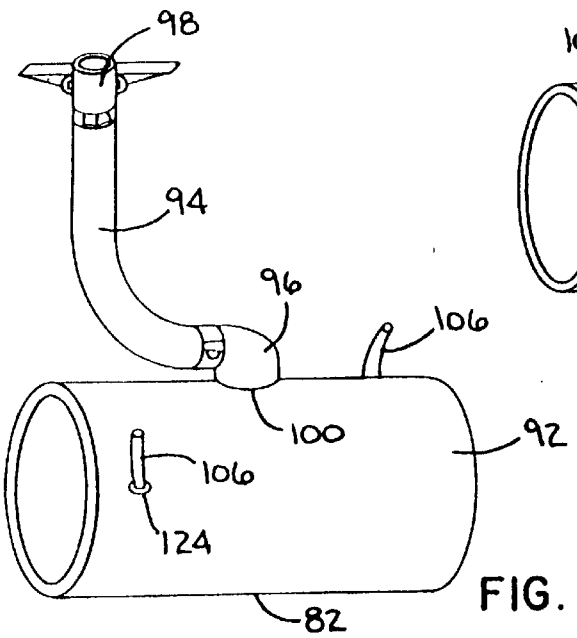
FIG. 10 is an enlarged plan view of an embodiment of a spline-connector used to connect two adjoining pipes in the header in the embodiment shown in FIG. 5, the spline-connector including a releasably attachable female coupling connected to a flexible hose element.

The connector 82, as shown in FIGS. 10, 11 and 12, is used in the main supply header 48 and the first section of the main return header 50 upstream to the U-shaped joint 86 in the system 44 shown in FIG. 5, and U-shaped joints 88 and 90 in the system 44 shown in FIG. 9. The connector 82 is also designed to connect the main supply header 48 and the main return header 50 to the supply subheaders 58 and the return subheaders 60.

The connector 82 may include a pipe section 92, a flexible hose 94, a fixed coupling 96 and either a male or female coupling 98. An opening 100 is machined in the pipe section 92 at half the distance from the ends. The opening 100 is then tapped to accept the threads of the fixed coupling 96. The pipe section 92 and the fixed coupling 96 are screwed together until the pipe section 92 and the fixed coupling 96 mate securely.

Figure 13:
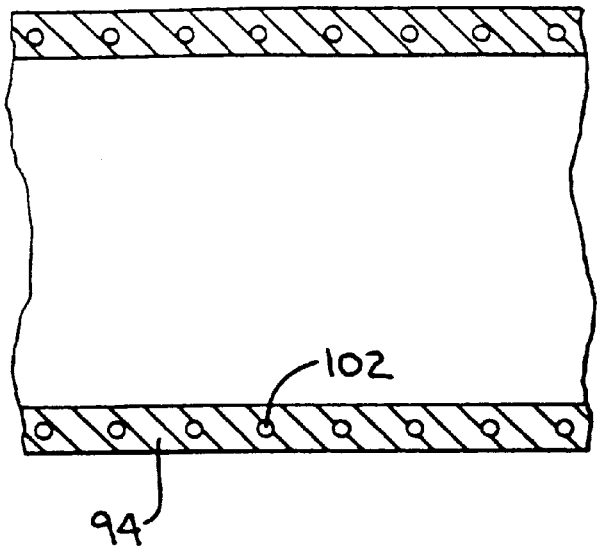
FIG. 13 is an enlarged, partial cross-sectional view of a flexible hose used to connect a spline-connector with either a supply or a return subheader.

A first, proximate end of the flexible hose 94, which has an inner diameter of one inch and is manufactured as shown in FIG. 13 with a helical steel spring 102 embedded within the wall of the hose 94, is then placed over a portion of the distal end of the fixed coupling 96 and secured using a circular clamp, for example, a stainless steel clamp. The second, distal end of the flexible hose 94 is then placed over a portion of the proximate end of the attachable coupling 98 and secured using a circular clamp, also a stainless steel clamp. The attachable coupling 98 allows the connector 82 to be connected to a mating male or female coupling 99 attached at the ends of the subheaders 58, 60.

Alternatively, the attachable coupling 98 is attached directly to the fixed coupling 96 of the supply header 48, while a mating male or female coupling 99 is attached via a flexible hose 94 to the supply subheader 58 and return subheader 60 corresponding to the given panel 52, as shown in FIG. 8. The mating couplings 99 are alternated between the supply and return subheaders 58, 60 for a given panel 52, i.e., each of the supply subheaders 58 may have a male coupling 99, while the return subheaders 60 may have a female coupling 99. In this fashion, when the system 44 is to be disassembled to be transported or stored, the coolant in the panel 52 can be isolated in the panel 52 by attaching the male coupling 99 of the supply subheader 58 to the female coupling 99 of the return subheader 60.

Moreover, the panels 52 may be isolated in operation as well as in storage by disposing a valve 104, for example, a brass or stainless steel ball valve, between the fixed coupling 96 and the attachable coupling 98 on the spline-connector 82, as shown in FIGS. 7 and 12. By connecting the valves 104 to the supply and return header connectors 82, the coolant in a panel 52 may be isolated by closing the valves 104.

By way of example only, isolation of the panel 52 could be advantageous should one of the coolant tubes 62, 64 of a panel 52 rupture. Isolation could prevent loss of the coolant into the medium to be frozen and the underlying foundational material, prevent loss of pressure throughout the system 44, and otherwise allow the repair of the panel 52 with the ruptured tube 62 or 64 to be performed while maintaining the frozen surface on the portions of the medium unaffected by the loss of coolant flow through the isolated panel 52.

Additionally, again by way of example only, isolation of the panels 52 could be advantageous during the freezing of the medium. Specifically, the panels 52 could be isolated so that the medium is frozen in stages, panel by panel, until all of the medium in the rink 46 is frozen. Such a staged process could be especially advantageous when attempting to freeze a medium when the temperature of the surrounding environment is substantially greater than the temperature at which the medium will freeze.

Figure 14:
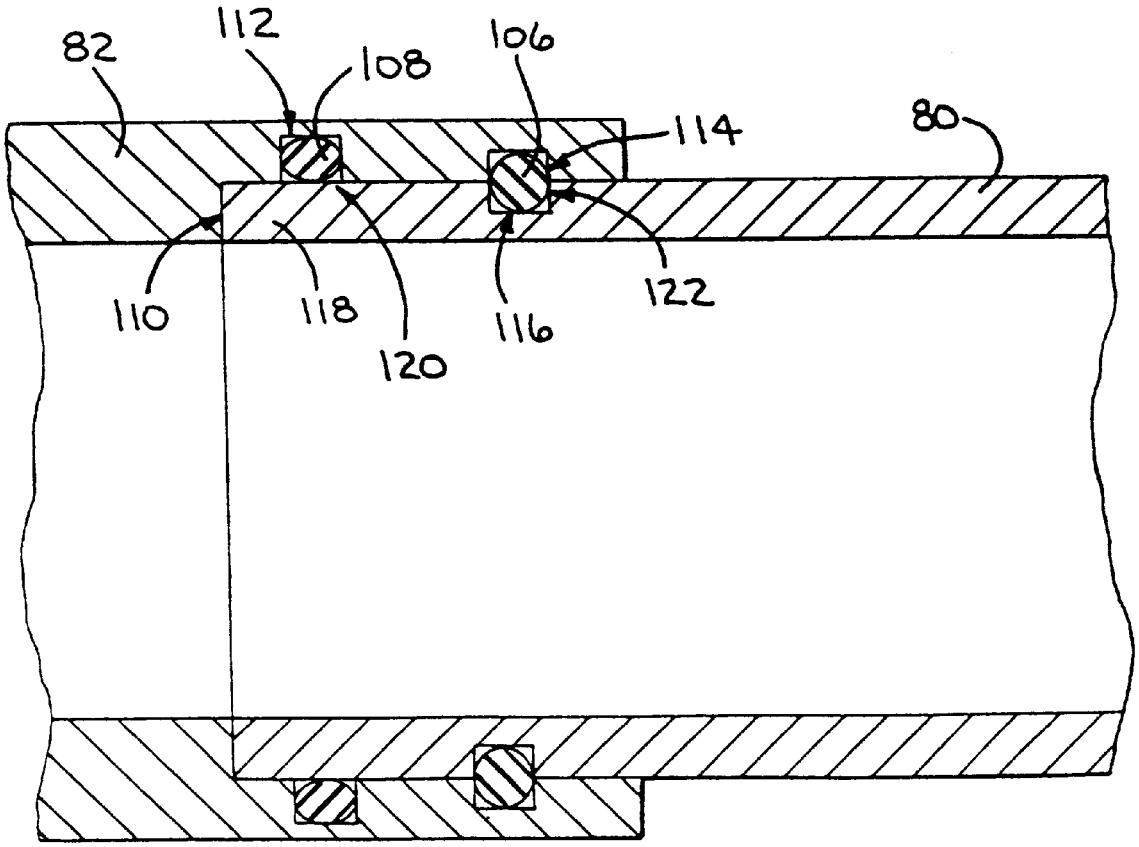
FIG. 14 is an enlarged, partial cross-sectional view of any of the embodiments of a spline-connector shown in FIGS. 10, 11, and 12 showing in detail a first and a second locking mechanism used to prevent relative movement between the spline-connector and a header pipe.

FIG. 14 shows the locking mechanisms used in any of the embodiments of the connectors 82 shown in FIGS. 10, 11 and 12. Particularly, each end of the connector 82 is machined to include a shoulder 110, an interior o-ring groove 112 and an interior spline groove 114. Similarly, each end of the pipe 80 is machined to have an exterior spline groove 116, which corresponds axially with the interior spline groove 114 of the connector 82 when the end 118 of the pipe 80 abuts the shoulder 110 of the connector 82.

In operation, an O-ring 108 is first placed in the interior O-ring groove 112. The pipe 80 is then placed into the connector 82 until the end 118 abuts the shoulder 110. The o-ring 108 and the exterior surface of the pipe 80 thus forms a first sealing and locking mechanism 120 preventing relative movement of the pipe 80 and the connector 82 in the axial direction. A second locking mechanism 122 is formed when the spline 106 is placed through a hole 124, the hole 124 being connected through the wall of the connector 82 to the interior spline groove 114. The spline 106 fills the channel formed by the corresponding interior and exterior spline grooves 114, 116, also preventing the relative movement of the pipe 80 and the connector 82 in the axial direction.

A further embodiment of the spline-connector, designated 84 in FIGS. 5, 7, 8, and 9, is used to couple the pipes 80 used in the second section of the main return header 50. Because the connectors 84 are not intended to be connected to the return subheaders 60, the connectors 84 are not manufactured with the opening 100 into which the fixed coupling 96 can be screwed. The connectors 84, like the connectors 82, however, do feature both the first and second locking mechanisms 120, 122.

Figure 15:
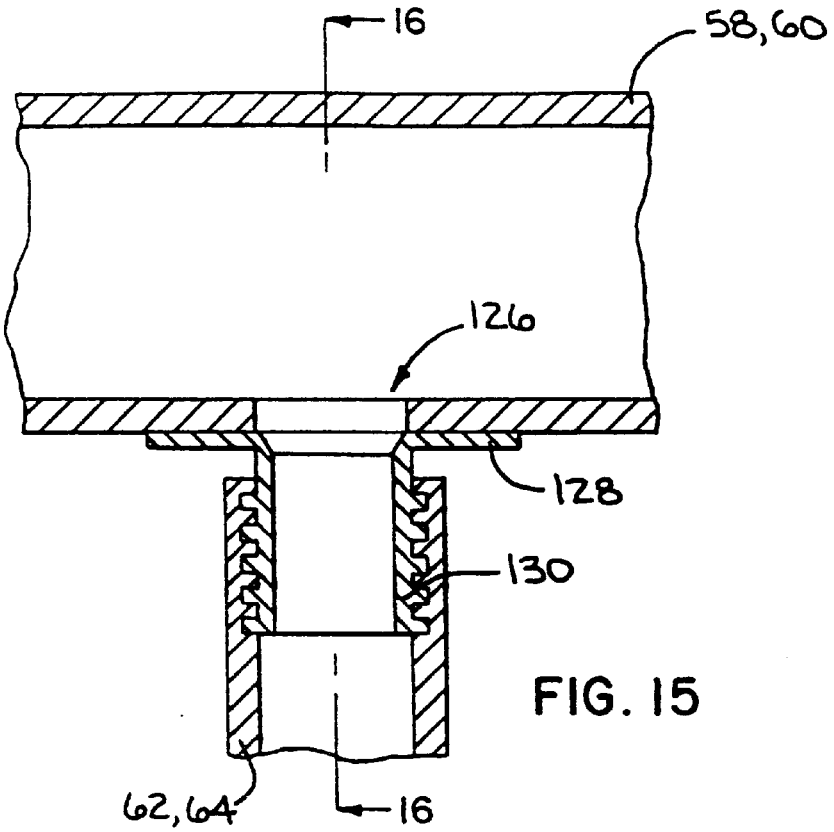
FIG. 15 is a partial cross-sectional view of an embodiment of the present invention showing in detail a transfer point at the intersection of a subheader with a coolant tube.
Figure 16:
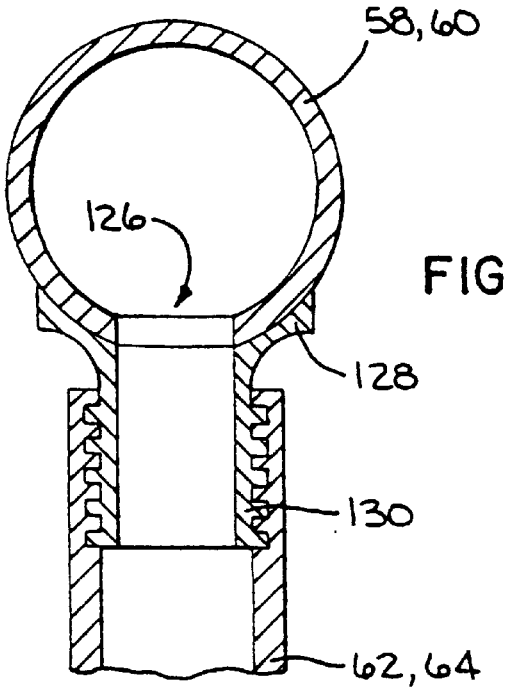
FIG. 16 is a partial cross-sectional view of the transfer point at the intersection of the subheader and the coolant tube taken about the line 16—16 in FIG. 15.

As shown in FIGS. 7 and 8, the panel 52 is defined by of the supply subheader 58, the return subheader 60, the first and second plurality of tubes 62, 64 and the plurality of U-shaped sections 66. As further illustrated in FIGS. 15 and 16, the supply and return subheaders 62, 64, fabricated from copper pipe, are machined with plurality of openings 126. A barbed saddle fitting 128, for example a copper fitting, is soldered over each opening 126, using a silver based solder. Use of the saddle fitting 128 is advantageous in that there is limited obstruction of the fluid flowing from the subheader 58, 60 into the tubes 62, 64 and the subheaders 58, 60 have a substantially uniform cross-sectional area. One end of one of the tubes 62, 64 is fitted over the barbed end 130 of saddle fitting 128 and fastened with a circular clamp. The use of barbed ends allows a secure attachment between the tubes 62, 64 and the subheader 58, 60 to be formed.

The tubes 62, 64 are made with a ½ inch inner diameter from a composition prepared using ethylene vinyl acetate (EVA), for example , from a composition prepared using 18% by weight of EVA combined with 82% by weight of polyethylene. The percentage of EVA may vary from between 15–25% by weight, while the polyethylene may vary from between 75–85% by weight. During manufacture, the composition is extruded to form the tubes and is passed through a cooling tank at a rate of 1 foot per second. Unlike the conventional methods for manufacturing the polyethylene or polypropylene tubing described above, the EVA/polyethylene tubes are passed through a cooling tank or tanks for a distance of between 25 and 36 feet with the tubes in a substantially straight configuration. The tubes may be cooled by spraying the tubes with water in the cooling tank or tanks, or by passing the tubes through a water bath maintained in the cooling tank or tanks. It is thought that the time spent by the tubes in the cooling tank or tanks allows the EVA/polyethylene tubes to thermally-set in a substantially straight configuration. The extruded, cooled product, having a final inner diameter of ½ inch, is then hand-coiled with the effective diameter of the coil being no less than 2.5 feet, and placed into a gaylord container for shipping. The tubes are fabricated in length s of between 515 to 520 feet.

The tubes 62, 64 are joined in pairs, the proximate end of the tube 62 attached to the supply subheader 58 and the proximate end of the tube 64 to the return subheader 60. Similarly, the distal ends of the pair of tubes 62, 64 are connected to one of the ends of the plurality of U-shaped connectors 66.

Figure 17:
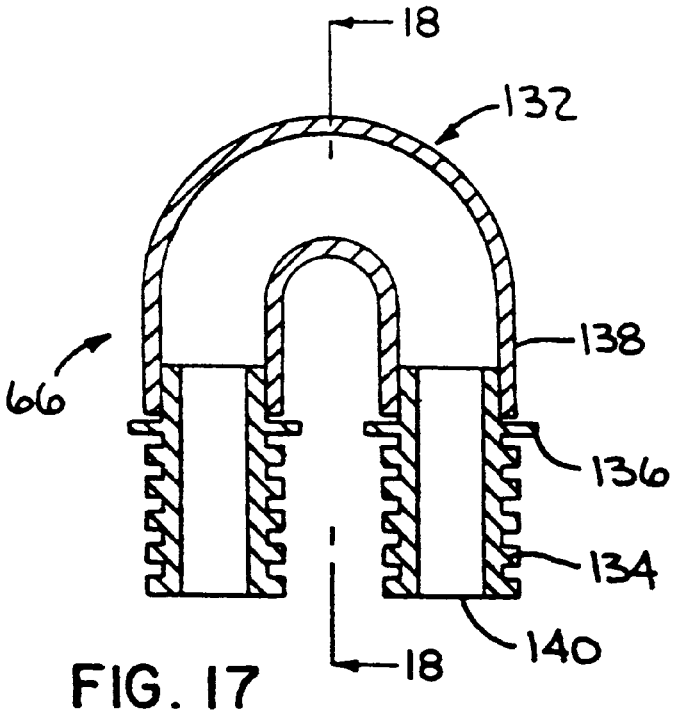
FIG. 17 is a cross-sectional view of an embodiment of the present invention showing in detail a U-shaped connector.
Figure 18:
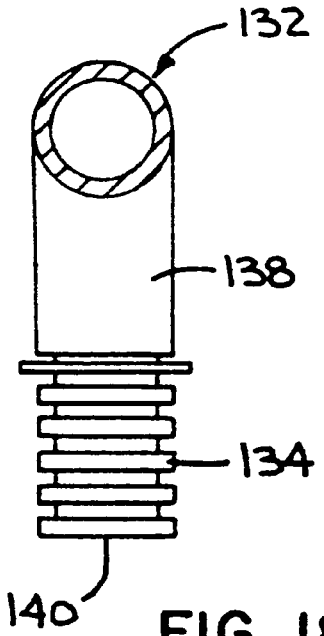
FIG. 18 is a cross-sectional view of the U-shaped connector taken about line 18—18 in FIG. 17.
Figure 19:
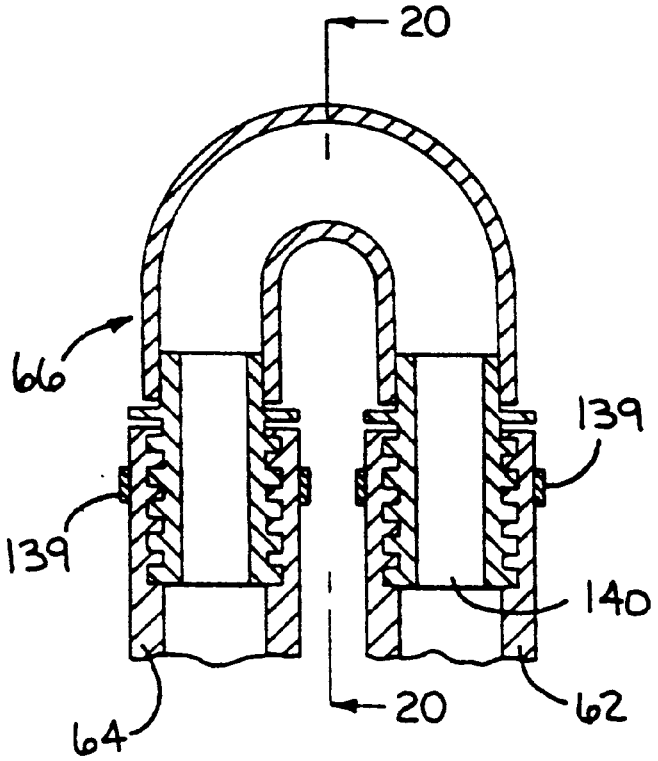
FIG. 19 is a partial cross-sectional view of the U-shaped connector of FIGS. 17 and 18, showing in detail the interconnection of the U-shaped connector and a coolant tube.
Figure 20:
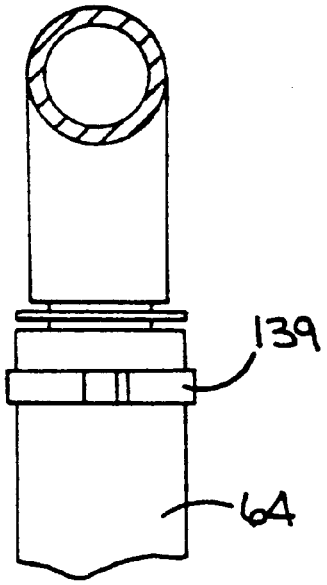
FIG. 20 is a cross-sectional view of the U-shaped connector and the coolant tube taken about the line 20—20 in FIG. 19.

As illustrated in FIGS. 17 and 18, each U-shaped connector 66 has a U-shaped section 132 and a pair of barbed fittings 134. The U-shaped section 132 and the barbed fittings 134 are made of copper. The distal ends 136 of the barbed fittings 134 are placed inside of ends 138 of the U-shaped section 132 and soldered in place using a silver based solder. As shown in FIGS. 19 and 20, one of the distal ends of tubes 62, 64 is then placed over each of the barbed, proximate ends 140 of the barbed fitting 134, and fastened into place using a circular clamp 139.

The U-shaped section 132 is of a constant inner diameter, for example, of nearly equal diameter to the tubes 62, 64 and thus provides a substantially continuous and substantially uniform cross-sectional area through which the coolant medium can pass. Furthermore, the barbed ends 140 of the fitting 134 provide for a secure attachment site to attach the ends of the tubes 62, 64 to the U-shaped connector 66.

A uniform spacing between the centers of the tubes 62, 64 is achieved in part by welding a bar 142, for example, a brass bar of hexagonal or rectangular cross-section, to the U-shaped bend in each of the U-shaped connectors 66 that make up the panel 52. As shown in FIGS. 7 and 8, the bar 142 can be straight or curved to keep the proper spacing between tubes 62, 64 even in the rounded corners of the ice rink 46. In addition, spacers 144, for example, made of polyethylene, are placed at intervals along the tubes 62, 64 to maintain the spacing between the tubes 62, 64 and the spacing between the tubes 62, 64 and the surface over which the system 44 is installed. The spacing between the centers of the tubes 62, 64 is between 1 and 1½ inches, while the spacing between the spacers 144 is approximately 14 inches.

The spacers 144 may either be removable or non-removable. If the spacers 144 are non-removable, i.e. enclose the entire circumference of the tubes 62, 64, then it is preferable to place the tubes 62, 64 through the spacers 144 before attaching the tubes 62, 64 to the barbed saddle fittings 128 of the supply and return subheaders 58, 60. If the spacers are removable, i.e. may be snapped around the tubes 62, 64, the spacers may be attached to the tubes 62, 64 after the tubes 62, 64 are connected to the respective supply and return subheaders 58, 60.

Still other aspects, objects, and advantages of the present invention can be obtained from a study of the specification, the drawings, and the appended claims.

We claim:

1. A system for creating a frozen surface on a medium, the system comprising:

means for exchanging thermal energy between a medium and a coolant;

means for removing thermal energy from a coolant; and means for transporting a coolant between the means for exchanging thermal energy between a medium and a coolant and the means for removing thermal energy from a coolant, the means for transporting a coolant including a header pipe assembly in fluid communication with the means for removing thermal energy from a coolant, the header pipe assembly comprising first and second pipes and means for releasably connecting the first pipe to the second pipe so as to prevent the first pipe from moving axially relative to the second pipe in a first operational state and to allow the first pipe to be moved axially relative to the second pipe in a second operational state, a subheader pipe in fluid communication with the means for exchanging thermal energy between a medium and a coolant, and means for releasably connecting the header pipe to the subheader pipe.

2. The system according to claim 1, wherein:

the first pipe has an outer surface with an effective outer diameter and a first groove defined in the outer surface, the second pipe has an inner surface with an effective inner diameter substantially equal to the effective outer diameter of the first pipe and a second groove defined in the inner surface, the first pipe is disposed within the second pipe in the first operational state so that the first and second grooves are aligned axially to define a passage, and the means for releasably connecting the first pipe to the second pipe to prevent the first pipe from moving axially relative to the second pipe comprises a strip of flexible material disposed in the passage to prevent the axial motion of the first and second pipes.

3. The system according to claim 2, further comprising means for preventing the first pipe from moving axially relative to the second pipe in the first operational state and for preventing a coolant from passing between the effective inner and effective outer diameters in the first operational state.

4. The system according to claim 3, wherein:

the second pipe has a third groove defined in the inner surface, and the means for preventing the first pipe from moving axially relative to the second pipe in the first operational state and for preventing a coolant from passing between the effective inner and effective outer diameters in the first operational state includes a ring of resilient material disposed within the third groove and against the outer surface of the first pipe such that the ring of resilient material is at least partially deformed.

5. The system according to claim 4, in combination with a tank containing a medium to be frozen, the means for exchanging thermal energy between a medium and a coolant disposed within the tank and in thermal communication with the medium contained within the tank.

6. The system according to claim 5, wherein the medium is an aqueous medium.

7. The system according to claim 1, in combination with a supply of coolant in fluid communication with the means for transporting a coolant between the means for exchanging thermal energy between a medium and a coolant and the means for removing thermal energy from a coolant.

8. The system according to claim 7, wherein the coolant comprises an alcohol selected from the group of alcohols consisting of ethylene glycol and propylene glycol.

9. The system according to claim 8, wherein the coolant comprises a mixture of an alcohol selected from the group of alcohols consisting of ethylene glycol and propylene glycol and water in a ratio of between 45:55 and 55:45.

10. A system for creating a frozen surface on a medium, the system comprising:

means for exchanging thermal energy between a medium and a coolant, means for removing thermal energy from a coolant:

means for transporting a coolant between the means for exchanging thermal energy between a medium and a coolant and the means for removing thermal energy from a coolant, the means for transporting a coolant including a header pipe assembly in fluid communication with the means for removing thermal energy from a coolant and a subheader pipe in fluid communication with the header pipe assembly and the means for exchanging thermal energy between a medium and a coolant such that coolant from the header pipe assembly must flow through the subheader pipe to pass through the means for exchanging thermal energy between a medium and a coolant the header pipe comprising first and second pipes and means for releasably connecting the first pipe to the second pipe so as to prevent the first pipe from moving axially relative to the second pipe in a first operational state, and to allow the first pipe to be moved axially relative to the second pipe in a second operational state, the subheader pipe having an axis and a wall with a first opening defined therein parallel to the axis, the first opening having a first area; and means for connecting the means for transporting a coolant to the means for exchanging thermal energy between a medium and a coolant so that substantially all of a coolant flowing from the means for transporting a coolant to the means for exchanging thermal energy between a medium and a coolant flows directly from the means for transporting a coolant into the means for exchanging thermal energy between a medium and a coolant, the means for connecting the means for transporting a coolant to the means for exchanging thermal energy between a coolant and a medium being attached between the subheader pipe and the means for exchanging thermal energy between a medium and a coolant, the means for connecting the means for transporting a coolant to the means for exchanging thermal energy between a coolant and a medium comprising a connector pipe with a seat which fits flush with the subheader pipe wall with the seat attached to the subheader pipe wall such that no portion of the connector pipe extends into the subheader pipe through the first opening, the seat having a second opening aligned with the first opening and having a second are at least equal to the first area.

* * * * *